US006079890A

United States Patent [19]

Gross et al.

[11] Patent Number: 6,079,890

[45] Date of Patent: Jun. 27, 2000

[54] FEED SYSTEM FOR A MARKING SYSTEM AND LASER MARKING SYSTEM

[75] Inventors: Frank D. Gross, Fenelton; Julius L. Hopson, Pittsburgh, both of Pa.

[73] Assignee: The Pannier Corporation, Pittsburgh, Pa.

[21] Appl. No.: 09/061,585

[22] Filed: Apr. 16, 1998

[51] Int. Cl.[7] ..... B41J 13/02

[52] U.S. Cl. ..... 400/636; 400/634; 347/264

[58] Field of Search ..... 400/636, 634, 400/633, 613; 101/47, 66, 72, 483; 347/264, 263, 245

[56] References Cited

U.S. PATENT DOCUMENTS

| | | | |
|---|---|---|---|
| 3,854,190 | 12/1974 | Stark | 29/432.1 |
| 4,515,867 | 5/1985 | Bleacher et al. | 428/204 |
| 4,572,886 | 2/1986 | Reid | 430/152 |
| 4,578,329 | 3/1986 | Holsappel | 430/18 |
| 4,595,647 | 6/1986 | Spanjer | 430/138 |
| 4,602,263 | 7/1986 | Borror et al. | 346/201 |
| 4,791,267 | 12/1988 | Yokoyama et al. | 219/121.69 |
| 4,975,714 | 12/1990 | Rose | 347/263 |
| 5,153,661 | 10/1992 | Shimizu et al. | 347/264 |
| 5,292,048 | 3/1994 | Vanerwiel | 227/21 |
| 5,397,686 | 3/1995 | Dommick et al. | 430/346 |
| 5,409,742 | 4/1995 | Arfsten | 427/555 |
| 5,482,391 | 1/1996 | Cook | 101/66 |
| 5,855,969 | 1/1999 | Robertson | 427/555 |

OTHER PUBLICATIONS

Pannier Drawing No. E 9530–A4 dated Nov. 21, 1998 showing a tag feed system that was on sale and/or in public use and/or published more than one year prior to the filing date of this application (Apr. 16, 1998).

Pannier Drawing (unnumbered and undated) showing a tag printer that includes the feed system shown in Reference AA, which was on sale and/or in public use and/or published more than one year prior to the filing date of this application (Apr. 16, 1998).

Pannier Drawing No. A3660–204 dated Jul. 3, 1997 showing a tag transport system that was on sale and/or in public use and/or published more than one year prior to the filing date of this application (Apr. 16, 1998).

Pannier Drawing No. Q705021 dated Sep. 12, 1997 that shows a laser marking system that includes the system shown in Reference AC.

*Primary Examiner*—Ren Yan
*Assistant Examiner*—Anthony H. Nguyen
*Attorney, Agent, or Firm*—Andrew J. Cornelius

[57] ABSTRACT

A tag feed system is used to feed tags through a marking machine, such as a tag printer or a laser marking machine, that marks information on the tags. A laser-marking system is used to mark and label information on metal tags, and a tag feed system for the laser-marking system that drives the tag material through the laser-marking system for marking. The laser marking system can include a housing, a laser for marking tag material, a tag unwind system for holding and supporting unlabeled tag material before it is marked and a tag retainer system for holding and supporting labeled tag material after it is marked. The tag feed system for feeding tag material through the laser marking system includes a housing unit that contains a first aperture through which tag material enters the housing unit for marking, a second aperture through which marked tag material exits the housing unit, and a lasing window through which a laser beam from the laser passes to mark tag material. The tag feed system also includes a drive unit assembly to move tag material through the feed system housing unit for lasing, a pressure unit assembly to press tag material against a component of the drive unit assembly, and a tension adjust device to exert a varying amount of tension to the pressure unit assembly. The laser-marking system also includes a control system for signaling the drive unit assembly to move and to stop moving tag material through the feeding apparatus housing unit.

5 Claims, 7 Drawing Sheets

FEED SYSTEM FOR A MARKING SYSTEM AND LASER MARKING SYSTEM

BACKGROUND OF THE INVENTION

The present invention relates to marking equipment and, more particularly, to a tag feed system for use in a marking system that is used to mark and label information on tags, and to a laser marking system that employs the feed system. The feed system is designed to feed tags through the marking system reliably and efficiently and to decrease the incidence of tag jams and misfeeds as the tags are moving through the feed system, while, additionally, providing for ease of maintenance and manufacture, and adaptability of the feed system and, therefore, of the marking system, for use with tags of differing width.

Laser marking systems that mark information on tags are known in the art, and are especially useful in marking information on high temperature tags that are used in high temperature environments in steel mills. It is also known in the art to use a feed system in a laser marking system to drive tags through the marking system for marking. Conventional feed systems used in tag marking systems (see attached drawing figure marked "PRIOR ART") are basically adaptations of well-known feed systems used in paper printing. The feed system shown in the drawing marked "PRIOR ART" has been used in a known laser marking system that marks metal tags These conventional feed systems are comprised of many components and are, therefore, usually quite costly to manufacture, assemble and maintain.

Additionally, because conventional feed systems employ many components, and because of the inherent complexities therewith, known feed systems are not products that the customers themselves can easily and independently maintain and repair. Personnel with specialized knowledge of the feed systems are needed for virtually all of the maintenance and repair requirements, however minor they may be. Oftentimes, the entire feed system itself must be disassembled to repair or replace a component as basic and simple as a belt, for example. Therefore, maintenance and repair of conventional feed systems are not only time-consuming but also require a fair degree of skill, for which personnel attempting to repair conventional feed systems must be trained.

Also, known feed systems must be oriented in a particular alignment within the printing machines or marking systems for proper operability, which requires the use of specialized equipment for installation of the systems. Therefore, most customers cannot themselves remove a malfunctioning feed system, and replace it with an "on-hand" operable feed system to avoid having the printing machine or marking system "shut down".

Further, because conventional laser marker feed systems are basically adaptations of paper printer feed systems, the tag pathway of conventional feed systems, that is, the path along which the tag must travel in order to be marked, can be relatively long, sometimes as long as five feet or longer. This long tag pathway, combined with the fact that the tags may not be continuously guided as they pass along the tag pathway, increases the chance that tags may run askew or jam as they are passing through the marking machine and being marked. Such jamming of tag material may decrease overall productivity of the laser marking machine, and may also cause damage to components of the feed system, which components may then need to be repaired or replaced.

Further, due in part to the large number of components in and the complexity of these feed systems, conventional feed systems are not readily adjustable for operation with tags of different widths. Therefore, customers must use tags of a particular width with particular marking machines, or contend with the arduous task of converting the feed system for use with tags of another width. This may require disassembly of the feed system, with many of the parts requiring replacement.

Finally, in order for a laser marking machine to be effective and efficient, the laser must be sealed so that the laser beam cannot escape and burn or damage an object or person. Thus, it is important to maintain light sealing within laser printers. With conventional feed systems, the feed system itself cannot be sealed shut because the tags must be inserted into the feed system, and then clamped and secured into place by "locking" the tag drive wheels in order that the tags may pass along the tag pathway. The inability to seal the feed system inevitably contributes to a loss in light sealing, and a degradation of the laser rating of the marking machine.

There exists, therefore, a need for a feed system for a marking system for tags, that can be easily manufactured and maintained, that can be adapted to tags of different widths, that can enhance the light sealing of the marking machine in which it is used, and that can provide reliable and efficient feeding of tags through the marking system.

SUMMARY OF THE INVENTION

The present invention substantially departs from the conventional concepts and designs of known feed systems used in tag marking systems. No known feed system provides the benefits and attributes of the present invention. Additionally, the conventional feed systems described herein do not suggest the present inventive combination of component elements arranged and configured as disclosed and claimed herein.

The present invention provides an improved feed system for use in a tag marking system that includes relatively few components, and that can be readily and easily removed from the marking system by a customer for maintenance and repair. The feed system has a relatively short tag pathway, on which the tags are continuously guided, minimizing the possibility that tags with rough edges may jam and run askew as they travel along the pathway. The present invention also provides a stable feeding unit which is automatic. That is, an end of the tag material is inserted into the feed system and the tags "take-off", without the need for additional clamping and securing of drive wheels by the operator. This automatic process of feeding tags into the system allows for the housing of the feed system to be sealed, which in turn increases the light sealing ability of the marking unit. Also, the feed system can be readily adapted to mark tags of different widths. The present invention also provides a laser marking system that incorporates the tag feed system provided by the present invention, and methods executed by the feed system and marking system.

The present invention also provides a tag feeding apparatus for a laser marking system that includes a housing unit with a first aperture and a second aperture, the first aperture being the aperture through which tag material enters the housing unit for marking and the second aperture being the aperture through which marked tag material exits the housing unit. The housing unit also includes a lasing window through which a laser beam from the laser marking device passes to mark the tag material located within the housing unit.

The feed system can include a drive unit assembly that moves tag material through the housing unit for lasing and a pressure unit assembly to press tag material against a component of the drive unit assembly to stabilize its movement through the housing unit. A tension adjuster device also can be included to exert a variable amount of tension to the pressure unit assembly, and a light seal roll assembly can be located within the housing unit adjacent the second aperture to prevent the laser light beam from escaping from the second aperture of the housing unit. At least one notch detector device can be provided to detect when a tag is in proper alignment within the housing unit, that is, properly aligned in front of the lasing window, for laser marking.

These and other advantages of the invention will be apparent to those skilled in the art from the following detailed description of the preferred embodiment of the invention.

DETAILED DESCRIPTION OF THE PREFERRED EMBODIMENT

Figure 1:
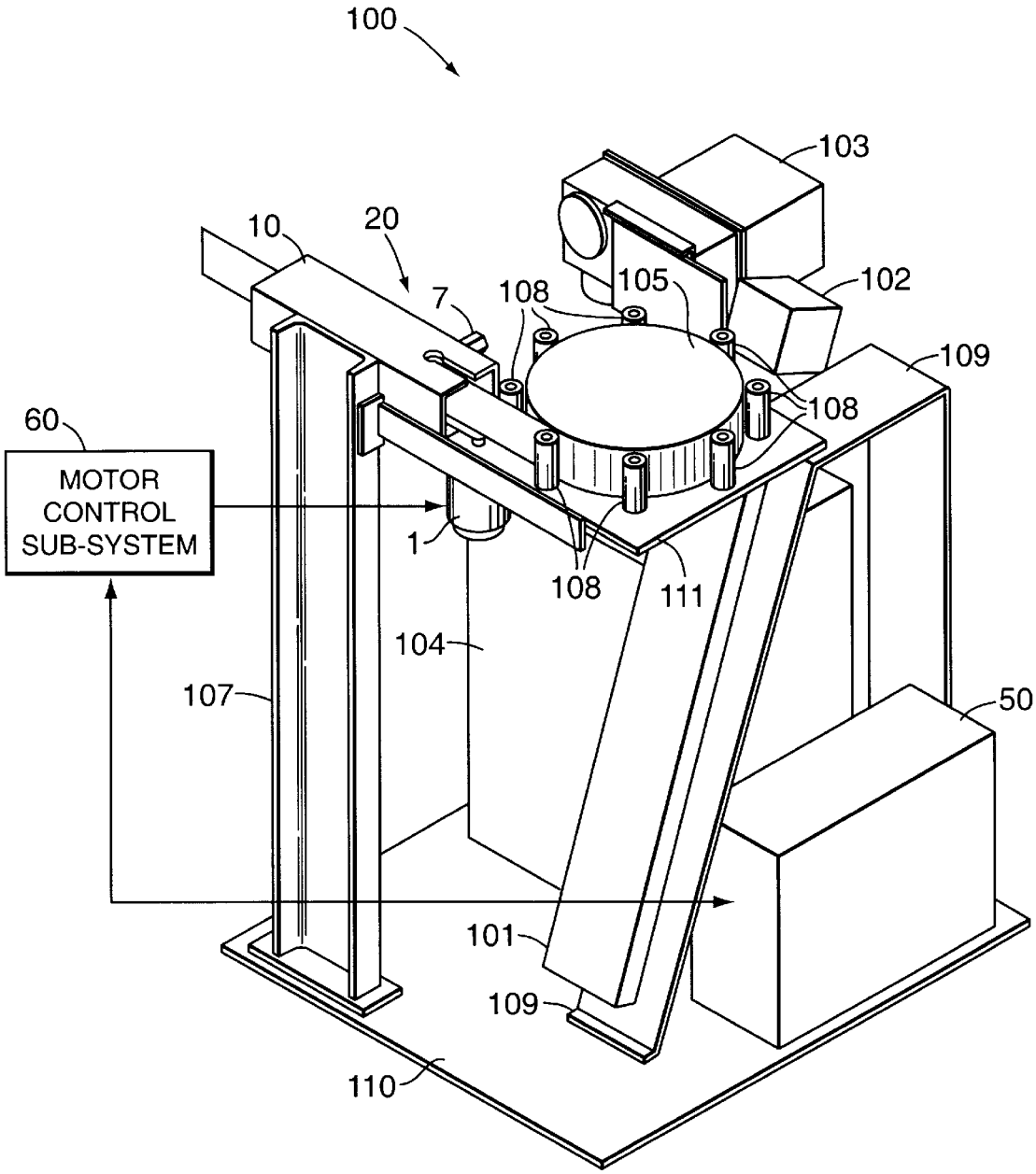
FIG. 1 is a perspective view of a laser tag marking, system that includes a feed system provided by the present invention.

While the tag feed system that is provided by the present invention can be used in a variety of types of tag markers and printers, it is shown in the drawing as used with a laser tag marking system. Referring to the drawings and particularly to FIG. 1, there is illustrated a laser tag marking system 100 that incorporates a feed system 20 to feed tag material through marking system 100 for marking, both of which are provided by the present invention. While FIG. 1 illustrates feed system 20 incorporated into a particular laser marking system 100, feed system 20 may be suitable for use with any laser marking system.

Laser tag marking system 100 includes a laser 101 that produces a laser beam that is directed to beam bender 102. Beam bender 102 may be any conventional, commercially available beam bender that is comprised of mirrors that alter the direction or path of the laser beam. Beam bender 102 directs the laser beam into marking head 103. Marking head 103 may be any suitable conventional, commercially available marking head, and is comprised of lightweight mirrors driven by galvanometers to control the laser beam, and to direct the beam into a marking area that is defined by feed system 20. Beam bender 102 can be assembled from the following components, which are available from Haas Laser Technologies, Inc., of Landing, N.J.:

1. KBB-100 Kinematic Bender Assembly, 1.0" C.A., holds 1.5" diameter optic
2. TC-100-GM Beam Tube Coupler (between beam bender and galvonometer head assembly)
3. TC-100-GM Beam Tube Coupler (between beam bender and laser head)
4. CM-15S-S 1.5" diameter 45 degree CO2 Bending Mirror, Enhanced Silver Coated.

Tag unwind system 105 serves to support and provide unmarked tag material to feed system 20 for marking. Guides 108 are utilized to direct the tag material into feed system 20 and to aid in the even unwinding of tag material from tag unwind system 105. Feed system 20 includes a housing unit 10 and a tension adjuster device 7 that provides pressure to the tag material as it is passing through feed system 20. Tension adjuster device 7 is located on an outside wall of housing unit 10, and disposed perpendicularly thereto, with one portion of tension adjuster device 7 being disposed to pass through an aperture in housing unit 10. Motor 1 is connected to feed system 20 to drive tag material through feed system housing unit 10 in a stepper fashion, which allows for each tag to enter feed system housing unit 10, stop, receive lasing, and exit feed system housing unit 10. Motor 1 is preferably a stepper motor, and is designed to receive control signals from a control system comprised of motor control sub-system 60 and computer 50, which may be any suitable personal computer.

The tag material is coated with any suitable coating that is known in the laser marking industry and which will alter appearance when exposed to a laser beam. When subjected to the controlled heating of the laser beam, the coating on each tag is physically altered, resulting in the tag being marked. Heat exchanger device 104, which may be any conventional heat exchanger device known in the laser marking industry, is utilized to keep laser 101 at a desired operating temperature, that is, at a temperature that keeps laser 101 both cool enough and warm enough to operate, preferably between 31° and 52° Celsius. Preferably, heat exchanger 104 is a PolyScience Model 3370 Heat Exchanger.

Laser 101 is secured in any suitable fashion to bracket 109, so that laser 101 and bracket 109 are substantially parallel to one another. One end of bracket 109 is mounted to base 110. Bracket 109 is configured and disposed to extend substantially perpendicularly from base 110, and therefore laser 101 is also disposed substantially perpendicular to base 110. Heat exchanger device 104 is secured in any suitable fashion to base 110, and is configured and disposed to cooperate with laser 101 to keep laser 101 at a desired operating temperature. Raised base 111 is configured and disposed parallel to base 110, and is attached to an end of bracket 107, which is opposite to the end of bracket 107 that is mounted to base 110. Beam bender 102 is secured in any suitable fashion to laser 101 and is positioned and disposed to receive a laser beam produced by laser 101, and to direct the laser beam into marking head 103. Marking head 103 is secured in any suitable fashion to bracket 109 and configured and disposed to receive the laser beam from beam bender 102 and to direct and focus the laser beam into a lasing or marking area that is defined by feed system 20. Feed system 20 is secured in any suitable fashion to one end of bracket 107. An opposite end of bracket 107 is mounted to base 110, so that feed system 20 and base 110 are substantially parallel to one another, with bracket 107 extending substantially perpendicularly therebetween.

Laser 101 is conventional, and may be a Synrad Model No. 48-2W, 25W Sealed CO2 Laser, Water Cooled, or a Synrad Model No. 48-5, 50W Sealed CO2 Laser, Water Cooled. Laser head 103 is conventional, and can be a Synrad Model DH3-370CH Marking Head.

Motor 1 is connected to feed system 20 to drive tag material through feed system housing unit 10 in a stepper fashion. Tag unwind system 105 is secured in any suitable fashion to base 111 and is configured and disposed to rotate circumferentially to supply tag material to feed system 20. Guides 108 are secured in any suitable fashion to base 111 and are configured and disposed to rotate circumferentially to guide the unmarked tag material from tag unwind system 105 into feed system housing unit 10.

Figure 2:
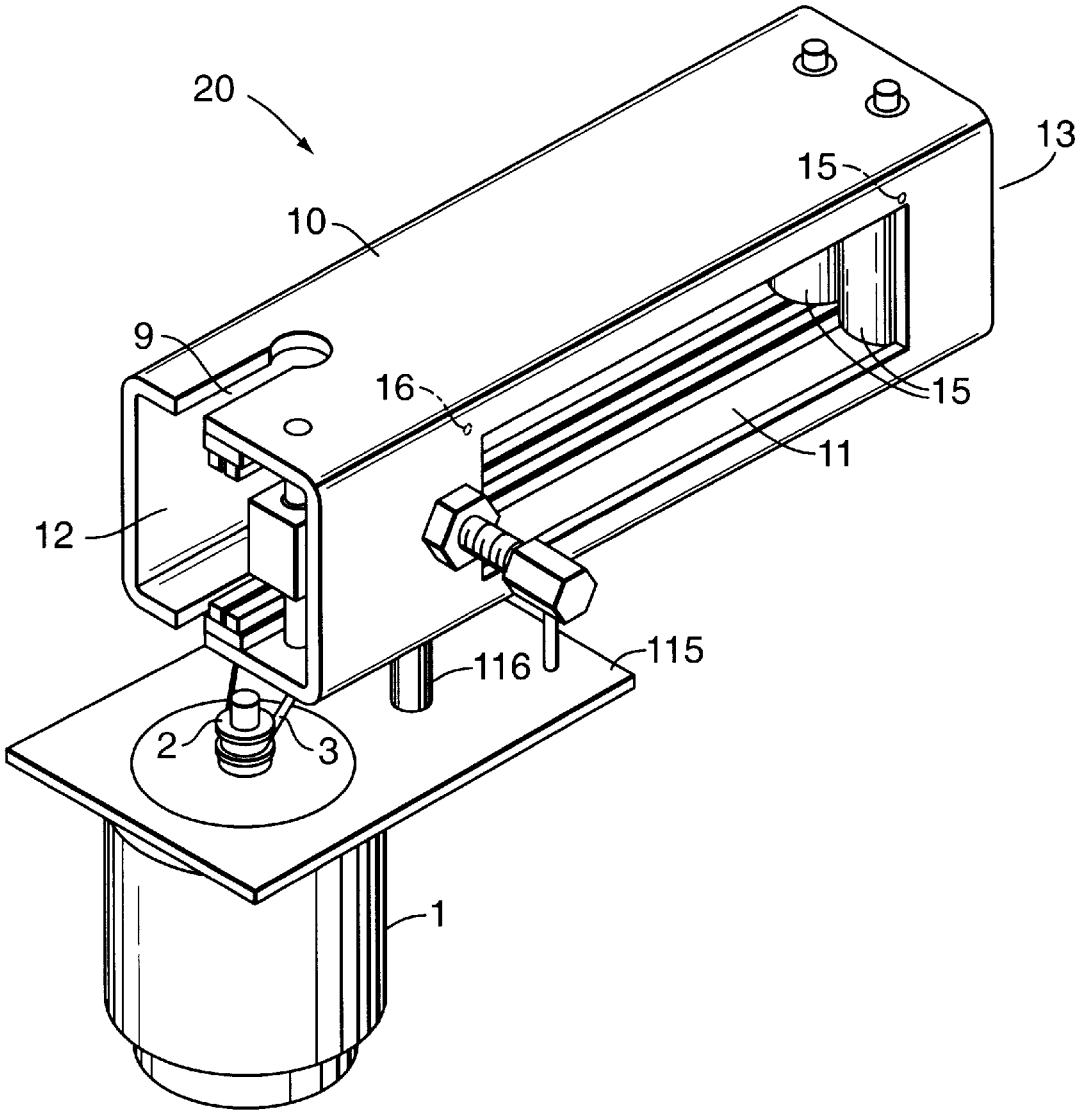
FIG. 2 is an isometric view of a feed system provided by the present invention.
Figure 4:
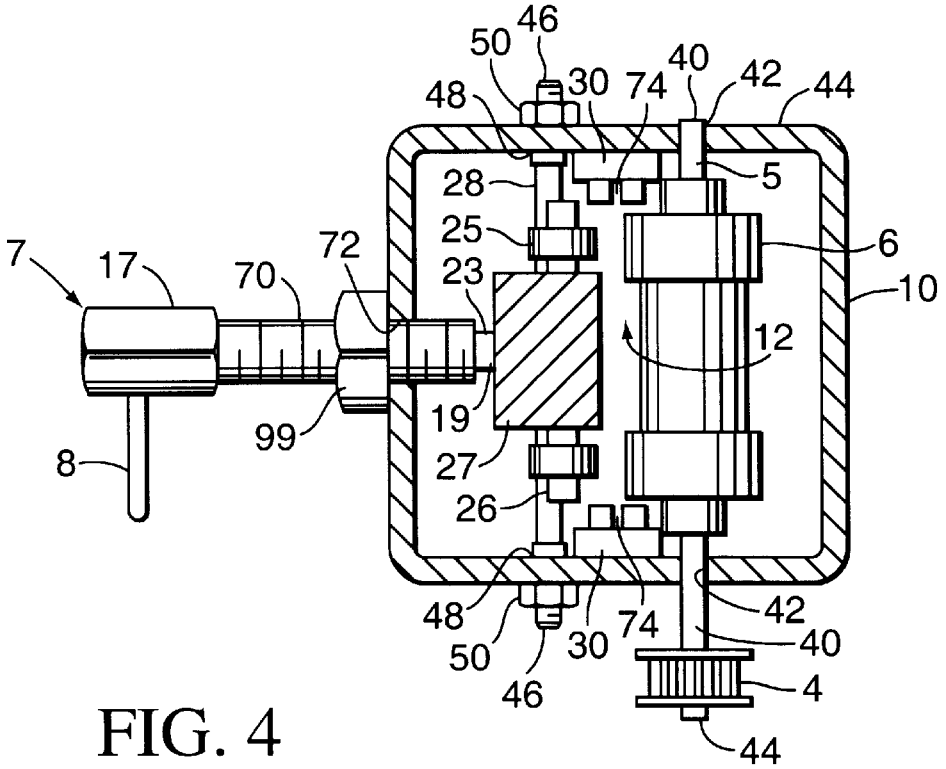
FIG. 4 is a perspective view of a feed system provided by the present invention from the tag insertion side of the system.

Referring to FIGS. 2 and 4, motor 1 may be secured in any suitable fashion to motor mount 115. Motor mount 115 is located between motor 1 and housing unit 10, to provide a stable connecting platform for the two devices. Housing unit 10 of feed system 20 is secured in any suitable fashion to stand off 116 mounted to motor mount 115. Housing unit 10 includes a first aperture 12 through which unmarked tag material may enter housing unit 10, a second aperture 13 through which marked tag material may exit housing unit 10, and defines a lasing or marking area 11 located between aperture 12 and aperture 13, in which the laser beam from laser 101 strikes the tag material and marks the tag where the beam strikes it. The beam produced by laser 101 is controlled in any known, suitable fashion to produce desired marks on the tag material in lasing area 11.

Mounted within housing unit 10 are spline shaft 5, drive roll 6 pinch roll 25, pivot shaft 26, light seal roll assemblies 35, notch detectors 15 and 16, and spacer devices 30. Slit 9 is defined by housing 10, and allows for assembly of spline shaft 5 and drive roll 6 within housing 10. Spline shaft 5 and drive roll 6 drive tag material through housing unit 10. Pinch roll 25 and pivot shaft 28 provide pressure to secure tag material against drive roll 6 to aid in the movement of the tag material through housing unit 10. Light seal roll assemblies 35 ensure that the laser beam does not escape from aperture 13 of housing unit 10. Notch detectors 15 and 16 are mounted in any suitable fashion within housing unit 10, and are used to determine when a tag is in position in the lasing or marking area 11 for marking. Any conventional notch detector may be utilized.

Tag material is fed between a pinch roll 25 and a drive roll 6, which are mounted parallel to each other for rotation within housing unit 10. Drive roll 6 is mounted on a spline shaft 5 and pinch roll 25 is mounted on a shaft 26 in any suitable fashion, and define a space 12 through which tag material is fed between rolls 6 and 25. Drive roll 6 is mounted in any suitable fashion to spline shaft 5 to permit roll 6 to rotate as spline shaft 5 is rotated. Shaft 5 is mounted at its ends 40 for rotation in holes 42 formed in opposite sides 44 of housing unit 10. Pinch roll 25 is mounted in any suitable fashion to shaft 26, which in turn is mounted in any suitable fashion for rotation to a drive pressure block 27. Pinch roll 25 is used to adjust the pressure applied to the tag material by rolls 6 and 25 as it is fed therebetween. A pivot shaft 28 is mounted for rotation at its ends 46 in holes 48 formed in opposite sides of housing unit 10. The threaded ends (not shown) of shaft 28 are secured with any suitable means including nuts 50. Spline shaft 5, shaft 26 and pivot shaft 28 extend transversely across the interior of the housing unit. Drive roll 6 and pinch roll 25 rotate with spline shaft 5 and shaft 26, respectively. The diameter of each of the ends of drive roll 6 and pinch roll 25 are greater than the central portions of each roll. Therefore, tag material passing between drive roll 6 and pinch roll 25 will contact drive roll 6 and pinch roll 25 at their end portions. Drive roll 6 may be coated with any conventional grit coating material to aid in maintaining contact between drive roll 6 and the tag material.

Pivot shaft 28 is mounted in any suitable fashion through and to pressure block 27 in a manner that allows block 27 to rotate as roll 25 and shaft 26 are rotated to adjust the pressure applied by rolls 6 and 25 to the tag material. Accordingly, pinch roll 25 applies more or less pressure to the tag material as block 27 is rotated toward or away from roll 25, respectively.

Figure 10:
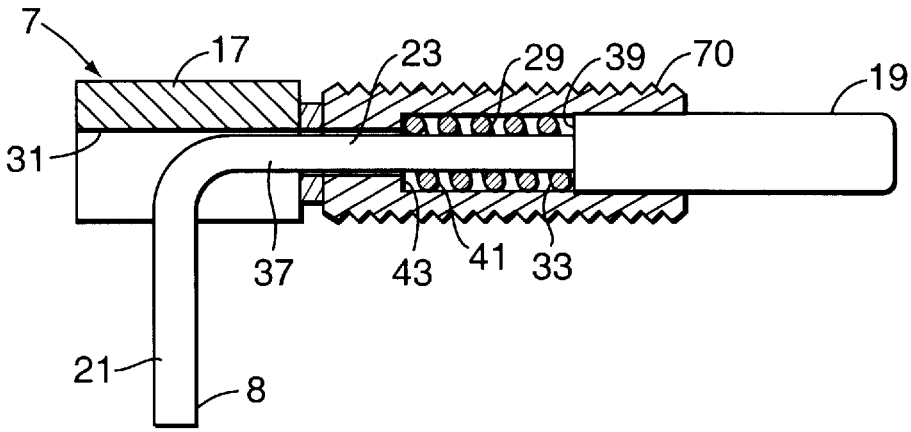
FIG. 10 is a sectional view of the tensioner adjuster device for the system shown in FIG. 2.
Figure 9:
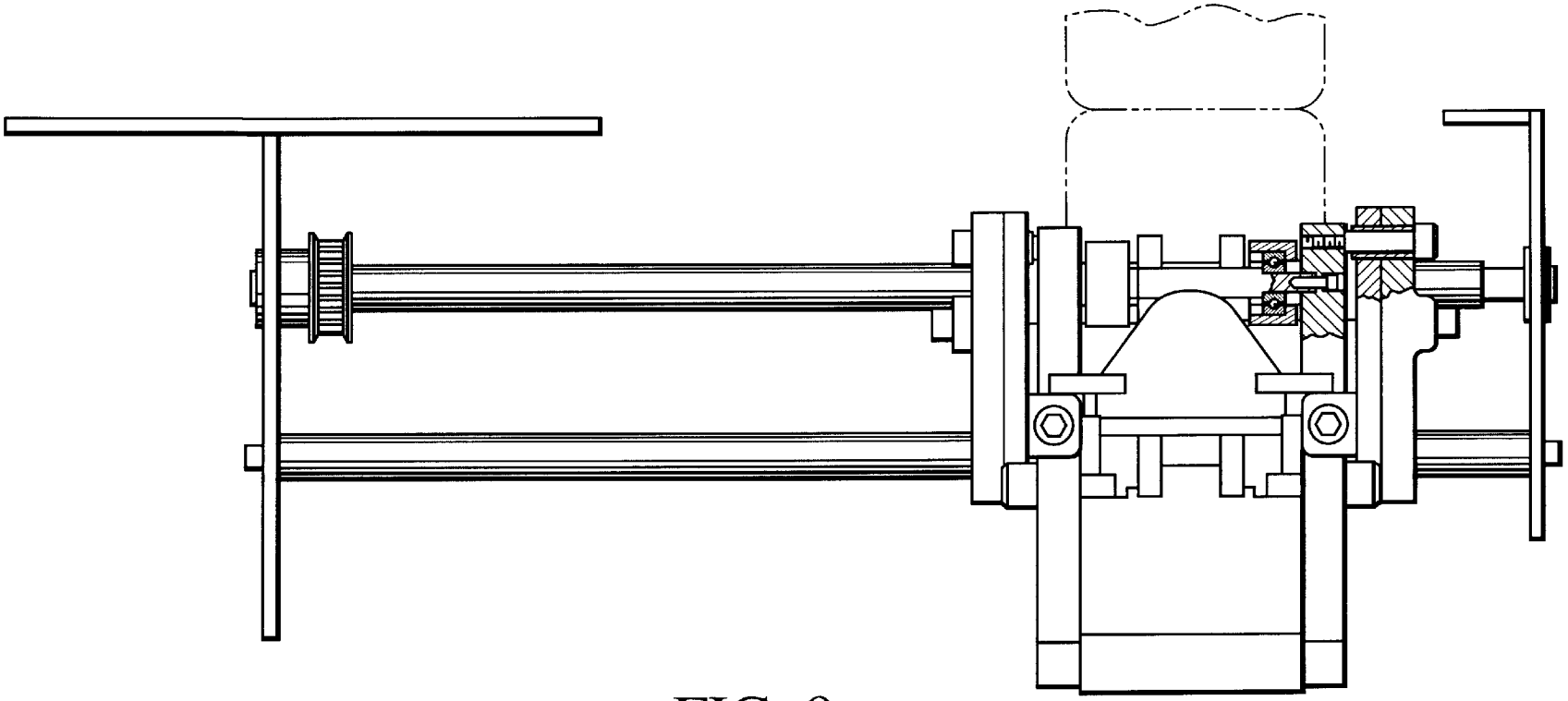
FIG. 9 (PRIOR ART)
FIG. 9 is a side elevation view of a prior art feed system.

Referring to FIG. 10, tension adjuster device 7 is conventional, and may be an FR-62 L-Handle Locking Hand Retractable Spring Plunger, which is commercially available from Reid Tool Company. Tension adjuster device 7 comprises a housing 17, plunger device 8, an interior coil spring 29 and nut 99. Tension adjuster device 7 defines a threaded end 70 onto which nut 99 is threaded. The threaded end 70 of adjuster 7 is threaded into a hole 72 formed in housing unit 10 so that end 19 of plunger device 8 contacts drive pressure block 27. Device 7 can be threaded into and out ot of housing unit 10 to increase and decrease, respectively, the pressure that block 27 and roll 25 exert against tag material located between rolls 6 and 25.

Plunger device 8 is "L" shaped. One leg 21 of plunger 8 extends from housing 17 through a slot 31, and functions as the handle to operate device 7 to temporarily release the pressure exerted by device 7 on pressure block 27, to allow an operator to manually pull tag material from housing unit 10. The other leg 23 of plunger 8, which terminates in end 19, defines a slender section 37 and wider section 19, both of which are located within and extends longitudinally within housing 17. Section 19 is adapted to bear against pressure block 27. Interior coil spring 29 is positioned around section 37 of leg 23. One end 33 of the spring 29 bears against a radial shoulder 39 that is formed on leg 23 inside housing 17 between section 37 and section 19. The other end 41 of the interior spring 29 abuts a radial shoulder 43 that is formed on the interior surface of housing 17. Accordingly, the interior spring is constrained between shoulders 43 and 39. An operator may grasp leg 21 of plunger 8 and pull plunger 8 so that it slides in the slot 31 which moves leg 23, and end 19 of leg 23, of plunger 8 away from pressure block 27, while at the same time compressing the interior spring 29 between the shoulders 39 and 43. Accordingly, the pressure that was exerted on block 27 and roll 25 against the tag material is released, and the operator may easily pull the tag material from housing unit 10. After the tag material is removed, the operator may release leg 21 of plunger 8, allowing the interior spring 29 to expand and force end 19 of leg 23 against pressure block 27 and cause it to rotate about pivot shaft 28 and cause pinch rolls 25 to exert pressure against the tag material and drive rolls 6.

Also located within housing unit 10 is a tag retainer system that holds tag material after it is marked. The tag retainer system includes a pair of guide or spacer units 30 and light seal roll assemblies 35. The two guide units or spacer unit 30 guide the tag material as it passes through housing unit 10. Guide units 30 may be secured in any suitable manner to the interior of opposite sides or walls 44 of feed system housing unit 10. Guide units 30 extend lengthwise along the longitudinal axis of the interior of housing unit 10 from aperture 12 to aperture 13. One guide unit 30 extends along the "top" of housing unit 10 along side 44, while the other guide unit 30 extends along the "bottom" of unit 10 along an opposite side 44. Each spacer unit 30 defines a channel or a space 74 which runs along the length of guide units 30 from aperture 12 to aperture 13. The edges of the tag material are located in the channels 74 of guide units 30 as it moves along the feed path and through lasing area 11.

Figure 5:
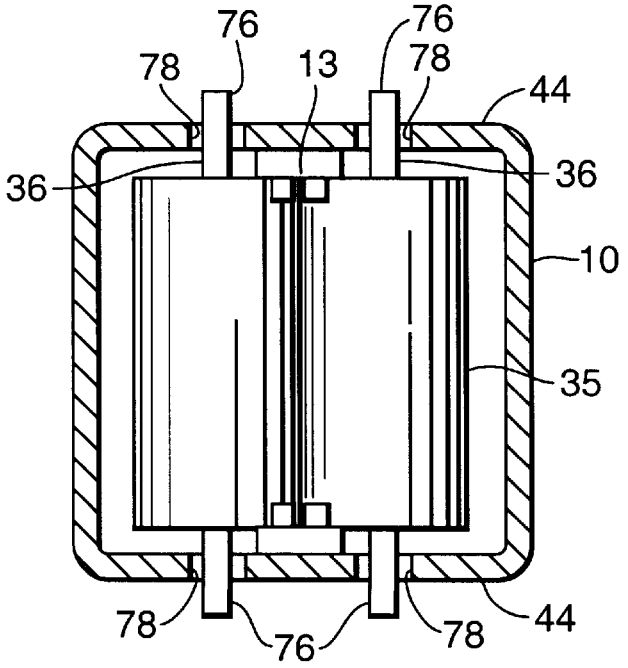
FIG. 5 is a perspective view of a feed system provided by the present invention from the tag exit side of the system.
Figure 6:
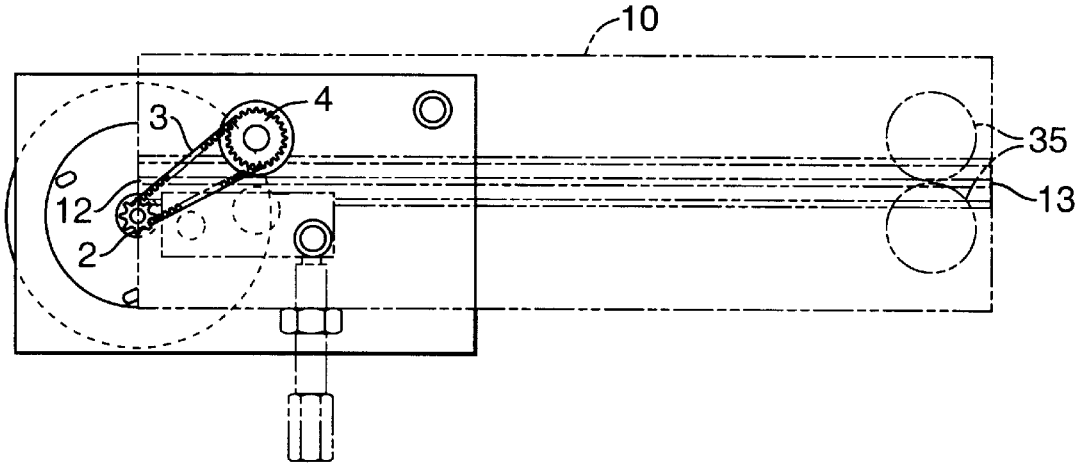
FIG. 6 is an orthogonal front phantom view of a feed system provided by the present invention.
Figure 8:
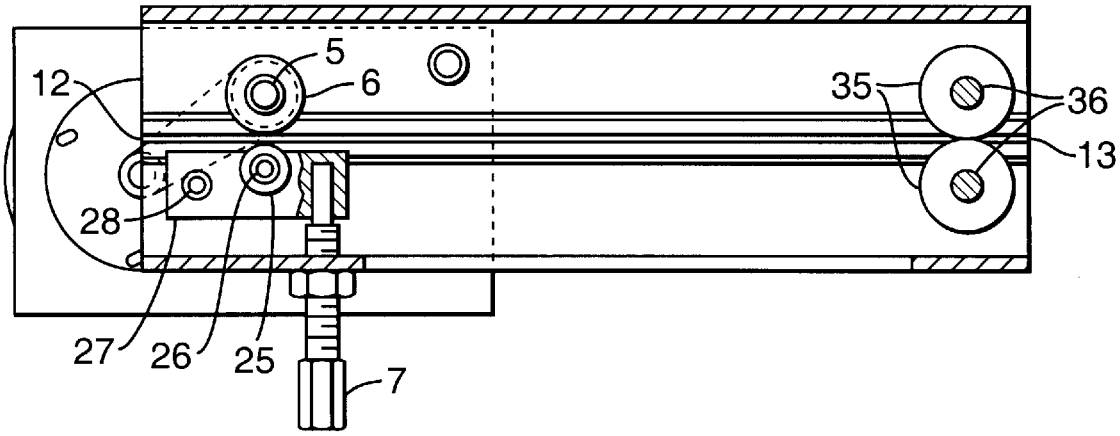
FIG. 8 is a cross-sectional view of a feed system provided by the present invention.

Referring to FIGS. 2, 5 and 8, light seal roll assemblies 35 are mounted within housing unit 10 adjacent aperture 13. Assemblies 35 are mounted in any suitable fashion to roll shafts 36, each of which is mounted at its ends 76 for rotation within holes 78 formed in opposite sides 44 of housing unit 10. Roll shafts 36 extend transversely across the interior of the housing unit. Tag material passes between rolls 35 as it is fed through housing unit 10. Assemblies 35 prevent the laser beam from escaping from housing 10 through aperture 13.

Figure 7:
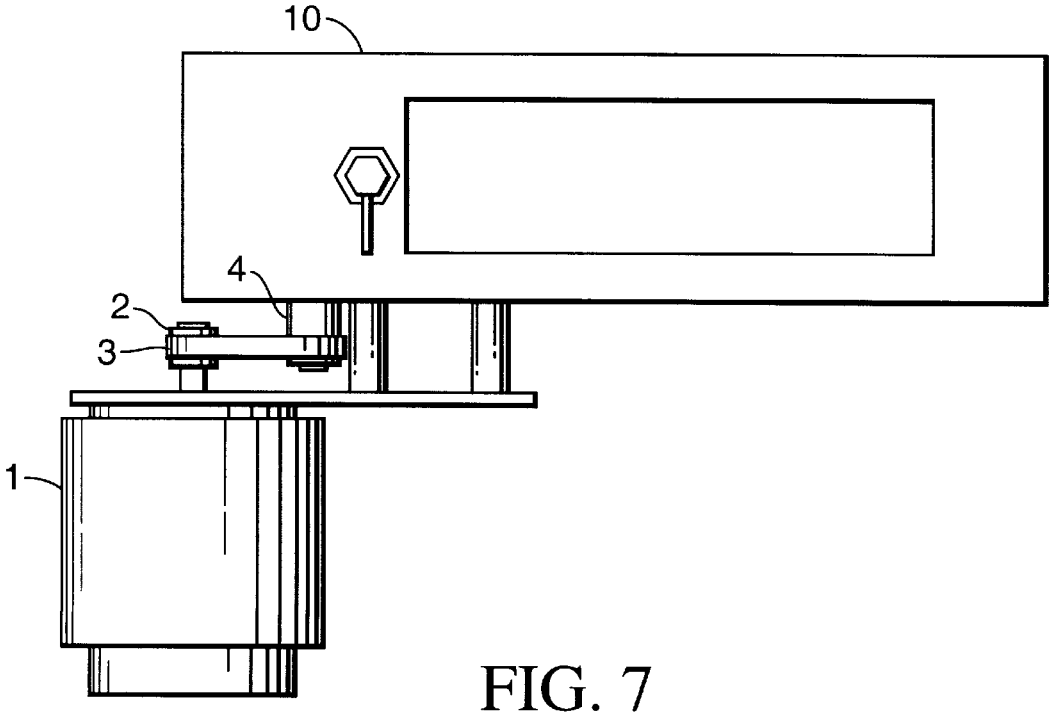
FIG. 7 is an orthogonal top view of a feed system provided by the present invention.

Referring to FIGS. 2, 4, and 7, feed system 20 also includes motor pulley 2, drive belt 3, and drive pulley 4, each of which is located outside of housing unit 10. Motor pulley 2 is mounted in any suitable fashion to the drive shaft of drive motor 1, and rotates therewith. Drive belt 3 is positioned around motor pulley 2 and a drive pulley 4, which is secured in any suitable fashion to the end of shaft 5 that extends from housing 10. Accordingly, rotation of the drive shaft by motor 1 causes pulley 2 to rotate, which, in turn drives belt 3 and rotates pulley 4. Rotation of pulley 4 causes corresponding rotation of drive roll 6, which feeds tag material through housing 10.

Figure 3:
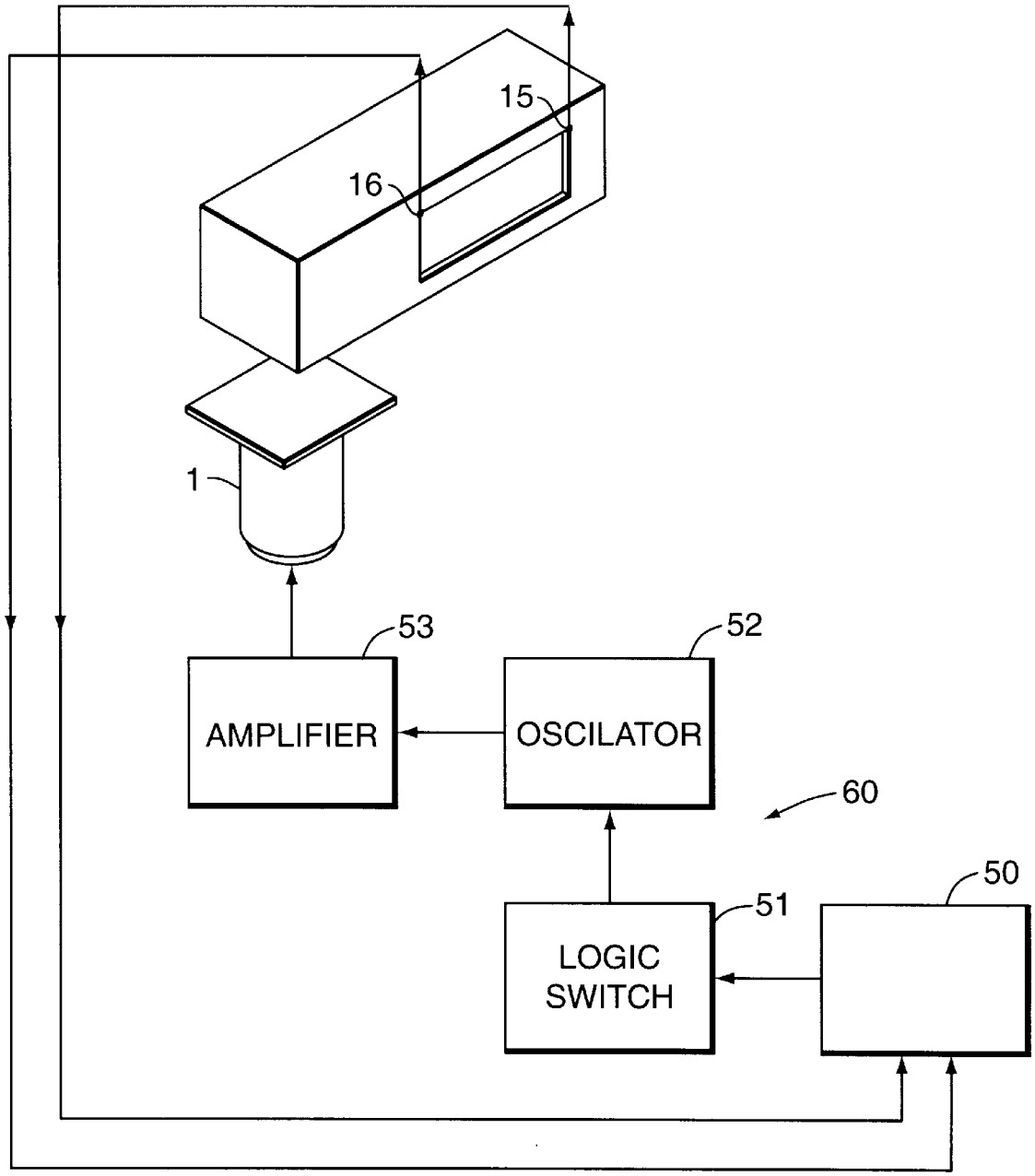
FIG. 3 is a block diagram showing the motor control sub-system for the feed system shown in FIG. 2.

Drive motor 1 is preferably a stepper motor that is designed to receive suitable control signals from any type of conventional control system. The control system must accelerate and decelerate motor 1 so that motor 1 may drive roll 6 and move tag material through housing unit 10 for marking. Accordingly, as a tag is marked, system 60 causes stepper motor 1 to unwind system 105 until the next tag in system 105 is in place to be marked, at which point motor 1 stops. Any conventional control system may be used. Referring to FIG. 3, a preferable electronic control system is comprised of computer 50, and a motor control sub-system that is comprised of a logic switch 51, stepper drive oscillator 52, and a stepper drive amplifier 53. The control system operates to accelerate and decelerate motor 1, in that it provides an "electronic move sequence" in which computer 50 sends a MOVE command to logic switch 51, which logic switch 51 supplies a closure to stepper drive oscillator 52, which oscillator 52 supplies pulses to stepper drive amplifier 53, which increases the signals to the drive motor 1. Oscillator 52 is preferably programmed to control acceleration and deceleration of motor 1 by varying the oscillatory rate.

Personal computer 50, motor control sub-system 60, logic switch 51, oscillator 52, and amplifier 53, are all conventional, and will not be described in detail. Logic switch 51 receives "STOP" and "MOVE" commands from computer 50 when computer 50 must stop and start, respectively, motor 1 and, accordingly, movement of the tag material. Switch 51 receives a "STOP" command from computer 50 to stop movement of the tag material when a tag is in place for marking in lase area 11, at which time computer 50 commands laser 101 to begin marking the tag in lase area 11. Switch 51 receives a "MOVE" command from computer 50 to move the tag material when the laser 101 has finished marking the material. Switch 51 produces an "ON" signal when it receives a "MOVE" command from computer 50 to move the tag material, and an "OFF" signal when it receives a "STOP" command from computer 50 to stop the tag material. When it receives an "ON" signal from switch 51, oscillator 52 produces a variable frequency square wave signal that is amplified by amplifier 53 to a level that is suitable to drive motor 1. When the "OFF" signal from switch 51 is present, oscillator 52 does not produce the square wave, but instead causes a continuous direct current to flow through motor 1. This current causes a fixed or stationary magnetic field, which holds the motor in a stationary position, and there is no movement of the tag material. The speed of rotation of the drive shaft of motor 1 is proportional to the frequency of the signal produced by oscillator 52. Oscillator 52 is preferably preprogrammed to control acceleration and deceleration of motor 1 by varying the frequency of the square wave it produces, to control the speed and acceleration and deceleration of the tag material as tags are moved to and from lase area 11. As is explained further below, the tag material defines notches between tags, which are sensed by notch detectors 15 and 16 to determine when a tag has been aligned for marking in lase area 11, at which time a suitable signal is sent from notch detectors 15 and 16 to computer 50, which issues a "STOP" command to switch 51.

Referring to FIGS. 2 and 4, tag material is inserted into first aperture 12 of feed system housing unit 10 for marking. As tag material is inserted into first aperture 12, each of the lengthwise "running" edges of the tag material rests in each of the indentures or channels 74 of the guide units 30, while one "flat" side of the tag material is in contact with pinch roll 25, and the other "flat" side of the tag material is in contact with drive roll 6. Tension adjuster device 7 is turned to adjust the pressure applied by roll 25 to the tag material, thus varying the degree of tension on the tag material. In many instances, the degree of desired tension will depend on the substance with which the tag material is made. For example, it may be necessary to exert greater tension on steel tag material than on aluminum tag material.

Motor pulley 2 rotates at varying speeds as motor 1 receives signals from the electronic control system and is accelerated and decelerated. As motor 1 rotates, motor 1 rotates motor pulley 2; motor pulley 2 moves drive belt 3; which, in turn, rotates drive pulley 4. The rotation of drive pulley 4 causes spline shaft 5 to rotate, which, in turn, causes drive wheel or drive roll 6 to rotate. As drive roll 6 rotates, it moves the tag material, which causes pinch roll 25 to rotate. Tag material passes through housing unit 10 until an interaction occurs with notch detector 15.

Notch detector 15 is conventional, and detects "notches" or indentations in the edges of the tag material. Notch detector 15 generates a signal to computer 50 each time it detects a notch in the tag material, which indicates the alignment of a tag in lase area 11 for marking. Computer 50 gives a "MOVE" signal to switch 51 to move the tag material until computer 50 receives a signal from notch detector 15, which computer 50 interprets as a signal that a tag has been positioned in lase area 11 for marking by laser 101. After the tag material has been lased, computer 50 sends a "MOVE" command to switch 51 to move the tag material until the next notch is detected by notch detector 15.

Generally, notch detector 15 may include a light source that produces a beam that is directed to the input of a first fiberoptic bundle. The first bundle guides the beam and focuses it on the input of a second fiberoptic bundle that is spaced from the output of the first bundle. The second bundle guides the beam to a photodetector that, when the beam is focused on it, produces a signal that is fed to computer 50. The tag material is fed between the output of the first bundle and the input of the second bundle in such a way that the edge of the tag material blocks the beam from the input of the second bundle and, accordingly, the photodetector. Therefore, when the tag material blocks the beam, the notch detector does not produce a signal to computer 50, which computer 50 interprets as the absence of a notch. However, the notches in the edge of the tag material between tags allow the beam to pass between the first and second bundles as the notches pass notch detector 15, which allows the beam to strike the notch detector, thus producing a signal to computer 50, which computer 50 interprets as the presence of a notch and alignment of a tag in lase area 11 for marking. At this point, computer 50 sends a "STOP" command to switch 51 to stop the tag in the lase area 11.

The notches in the tag material denote the space between the end of one tag and the beginning of an adjacent tag. Tag material continues to move through feed system housing unit 10 until first notch detector 15 detects a break or a notch in the tag material, which indicates that a tag is in position for marking in lasing area 11 of housing unit 10. At this point, first notch detector 15 signals computer 50, which sends a signal to logic switch 51, which logic switch 51 stops oscillator 52, which causes drive motor 1 to stop moving the tag material. This same signal from notch detector 15 signals to computer 50 that a tag is in position for marking, at which point computer 50 signals laser 101 of laser tag marking system 100 to begin lasing.

Referring to FIGS. 2 and 3, after a tag is moved into place in lasing area 11 and marking has occurred, the electronic move sequence described above repeats itself. This results in motor 1 being momentarily accelerated to drive the marked tag from housing unit 10 through second aperture 13, and to drive another tag through aperture 12 and into marking area 11. As explained in detail above, first notch detector 15 detects a notch in the tag material, and indicates that a tag is in position for marking, at which point the tag stops moving and marking occurs.

Feed system 20 includes a second notch detector 16, which is used for marking tags that are longer than lasing area 11. If the tag is longer than lasing area 11, the tag must be marked in a two-step sequential process. The marking process starts from the move sequence and proceeds as described above until after the first marking step has been accomplished. At this point, the move sequence repeats itself to drive the first, marked portion of the long tag from the marking area 11 and through aperture 13, and to drive the second, unmarked portion of the long tag into the marking area 11. Second notch detector 16 is located at a position within feed system housing unit 10 at which it detects the notch at the trailing end of the tag which indicates that the second, unmarked portion of the long tag is now in position in lasing area 11 for marking. Second notch detector 16 then signals to computer 50 that the trailing edge of the tag has been detected, and computer 50 sends a "STOP" command to logic switch 51, which stops oscillator 52, and stops motor 1. Computer 50 then signals laser 101 to begin lasing the second portion of the tag with the labeling information. After lasing is complete, computer 50 sends a "MOVE" command to switch 51 to start motor 1 and resume feeding tag material, and commands laser 101 to stop marking Once the labeling of the second portion of the tag is complete the entire marking sequence is repeated until all the tags are marked.

An advantage of this invention is that if jamming of the tag material within housing unit 10 does occur, the tag material may be simply and easily removed from housing unit 10 with the aid of plunger device 8. Plunger device 8 may serve to release the pressure exerted by pinch roll 25 onto the tag material if plunger device 8 is manually pulled away from housing unit 10. This allows for the release of the pressure exerted by pinch roll 25, so that the tag material may be manually pulled from housing unit 10 without untightening and releasing tension adjuster device 7.

Another advantage of system 100 is that guide units 30 of different sizes may be used, enabling feed system 20 to feed tag material of different widths. For example, if "larger" guide units 30 are used, which extend further from side 44 of housing 10 and into the interior of housing 10, tags of a smaller width may be marked.

Another advantage of system 100 is that feed system 20 is mounted in any suitable fashion to bracket 107, and is not located in an enclosed area of system 100. Therefore, feed system 20 is located so that it is readily and easily accessible to be removed from system 100 for repair or replacement.

The appended drawings in their entirety, including all dimensions, proportions, and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents and publications recited herein, and in the Declaration attached hereto, are hereby incorporated by reference as if set forth in their entirety herein.

The details in the patents and publications may be considered to be incorporable, at Applicant's option, into the claims during prosecution as further limitations in the claims to patentably distinguish any amended claims from any applied prior art.

Although only a few exemplary and preferred embodiments of this invention have been described in detail above, those skilled in the art will readily appreciate that many modifications are possible in the exemplary embodiments without materially departing from the novel teachings and advantages of this invention. Accordingly, all such modifications are intended to be included within the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. Tag feeding apparatus for feeding tag material through a tag marking system, said tag feeding apparatus comprising:

a housing unit defining a first aperture, a second aperture and a lasing window and at least two guide devices, said at least two guide devices extending lengthwise along said housing unit walls from said first aperture to said second aperture, said guide devices each comprising guide channel that receives the edge of the tag material to guide the tag material through the housing, said first aperture being the aperture through which tag material enters said housing unit for marking, said second aperture being the aperture through which marked tag material exits said housing unit; and said lasing window permitting the beam produced by a laser marking device to enter said housing unit to mark tag material located within said housing unit;

a drive unit assembly that moves tag material through said housing unit for marking, said drive unit assembly including a drive roll rotatably mounted to said housing that moves tag material through said housing unit for lasing and a drive motor operatively connected to said drive roll that rotates said drive roll; and a pressure unit assembly by which the tension on the tag material can be adjusted, said pressure unit assembly including a pivot shaft mounted to said housing for rotation and a pinch roll rotatably mounted to said pivot shaft proximate and parallel to said drive roll, rotation of said pivot shaft adjusting the distance between said drive roll and the pinch roll, the tag material being fed between said drive roll and said pinch roll said pressure unit assembly passing through a wall of said housing unit and exerting a force perpendicularly to a drive pressure block, causing said drive pressure block to exert a proportional force on said pinch roll, causing said pinch roll to exert a proportional force to the tag material to press the tag material against said drive roll, and a plunger device being disposed within said pressure unit assembly, said plunger device being disposed to move laterally in response to a pulling force to temporarily release tension exerted by said pressure unit assembly and thus tension exerted onto the tag material by said pinch roll;

a light seal roll assembly; said light seal roll assembly being disposed within said housing unit and adjacent said second aperture, said light seal roll assembly preventing the laser beam from escaping from said second aperture of said housing unit;

said housing unit further comprising at least one notch detector device, said notch detector device being disposed within said housing unit and detecting when a tag is in proper alignment within said housing unit, in front of said lasing window, for marking.

2. A laser marking system comprising:

a housing;

a laser for marking tags in the form of a continuous strip of tag material;

a tag unwind system for holding and supporting an unlabeled of tag material before it is marked;

a tag feeding apparatus for feeding the strip of tag material through said laser marking system, said tag feeding apparatus comprising:

a housing unit comprising a first aperture and a second aperture; said first aperture being the aperture through which the strip of tag material enters said housing unit for marking;

said second aperture being the aperture through which the marked tag material exits said housing unit;

a lasing window; said lasing window being the window through which a laser beam from said passes to mark a portion of the strip of tag material;

a drive unit assembly, being configured and disposed to move the strip of tag material through said feeding apparatus housing unit to the lasing window for lasing;

a pressure unit assembly being configured and disposed to press the strip of tag material against a component of said drive unit assembly as the strip travels through said housing; and a tension adjust device being configured and disposed adjacent said pressure unit, said tension adjust device being disposed to exert a varying amount of tension to said pressure unit assembly; and a control system for signaling said drive unit assembly to move and to stop moving the strip of tag material through said feeding apparatus housing unit.

3. The apparatus according to claim 2 further comprising a tag retainer system for holding and supporting labeled tag material after it is marked.

4. A method of marking tags in the form of a continuous strip of tag material comprising the steps of feeding the strip of tag material through a laser marking system, said laser marking system comprising:

a housing;

a laser for marking the strip of tag material;

a tag unwind system for holding and supporting the unlabeled strip of tag material before it is marked;

a tag feeding apparatus for feeding the strip of tag material through said laser marking system to an area where the material is marked, said tag feeding apparatus comprising:

a housing unit comprising a first aperture and a second aperture;

said first aperture being the aperture through which the strip of tag material enters said housing unit for marking;

said second aperture being the aperture through which marked the tag material exits said housing unit;

a lasing window; said lasing window being the window through which a laser beam from said passes to mark the strip of tag material;

a drive unit assembly, being configured and disposed to move the strip of tag material through said feeding apparatus housing unit to said lasing window for lasing;

a pressure unit assembly being configured and disposed to press the strip of tag material against a component of said drive unit assembly; and a tension adjust device being configured and disposed adjacent said pressure unit, said tension adjust device being disposed to exert a varying amount of tension to said pressure unit assembly; and a control system for signaling said drive unit assembly to move and to stop moving the strip of tag material through said feeding apparatus housing unit;

using said tag feed system to move tags in the strip of tag material to and from a marking area; and marking tags in the continuous strip of tag material moved to the marking area by said tag feed system.

5. The method of marking tag material according to claim 4 wherein said laser marking system further comprises a tag retainer system for holding and supporting labeled tag material after it is marked.

* * * * *